US006983962B2

(12) United States Patent
Keightley

(10) Patent No.: US 6,983,962 B2
(45) Date of Patent: Jan. 10, 2006

(54) DEADLOCK ARRANGEMENT FOR LOCKS

(75) Inventor: Kym John Keightley, Fairview Park (AU)

(73) Assignee: Inovec Pty Ltd., Dulwich (AU)

( * ) Notice: Subject to any disclaimer, the term of this patent is extended or adjusted under 35 U.S.C. 154(b) by 0 days.

(21) Appl. No.: 10/734,015

(22) Filed: Dec. 10, 2003

(65) Prior Publication Data

US 2005/0127684 A1 Jun. 16, 2005

(51) Int. Cl.
*E05C 1/12* (2006.01)

(52) U.S. Cl. ..... 292/144; 292/142; 292/39; 74/109; 74/422; 70/278.7

(58) Field of Classification Search ..... 292/144, 292/142, 160, 172, 39, 279; 70/275, 277, 70/278.7, 280; 74/89.11, 109, 422, 120
See application file for complete search history.

(56) References Cited

U.S. PATENT DOCUMENTS 2,771,313 A * 11/1956 Blake ..... 292/142
3,638,461 A * 2/1972 Watson ..... 292/142
4,502,716 A * 3/1985 Tsai ..... 292/142
5,172,944 A * 12/1992 Munich et al. ..... 292/39
5,265,452 A * 11/1993 Dawson et al. ..... 292/142
5,280,881 A * 1/1994 Karmin ..... 292/142
5,301,989 A * 4/1994 Dallmann et al. ..... 292/142
5,642,909 A * 7/1997 Swan et al. ..... 292/39
5,791,179 A * 8/1998 Brask ..... 292/142
5,890,753 A * 4/1999 Fuller ..... 292/142
6,217,087 B1 * 4/2001 Fuller ..... 292/39
6,478,345 B1 * 11/2002 Viney ..... 292/39

* cited by examiner

*Primary Examiner*—Brian E. Glessner
*Assistant Examiner*—Christopher Boswell
(74) *Attorney, Agent, or Firm*—Sand & Sebolt

(57) ABSTRACT

A deadlocking assembly for use in locks that includes a rack supporting a bolt and a driving or pinion gear that drives the rack. Both the rack and the pinion gear have teeth that intermesh. The pinion gear further includes two arms, one of which acts as a stop when extending the bolt and the other that acts as a deadlock. When in the deadlocked position, forcing of the bolt is prevented by the other arm since the pinion gear teeth and the rack gear teeth at that position do not intermesh. A tab is further used to limit further rotation of the pinion gear.

19 Claims, 4 Drawing Sheets

DEADLOCK ARRANGEMENT FOR LOCKS

BACKGROUND OF THE INVENTION

The present invention relates to lock and in particular to an improved deadlock arrangement where a bolt locks a door across an entrance.

There are many locks that can be deadlocked. However, these locks are cumbersome and are not particularly adaptable for locks of the type that can be driven by two independent means, such as key and electric motor operation. Further they do not provide a good drive ratio requiring significant torque to operate the lock.

It is an object of the present invention to propose a rack and pinion lock that overcomes at least some of the aforementioned problems or provides the public with a useful alternative.

SUMMARY OF THE INVENTION

Therefore in one form of the invention there is proposed a deadlocking assembly for use in locks said assembly including:

a lock bolt operatively coupled to a rack;

a drive means adapted to be rotatably driven and adapted to engage said rack to cause it to move in one axis;

said drive means including a deadlocking arrangement whereby when said bolt is in an extended position external movement of the bolt towards the retracted position causes said rack to abut said deadlocking arrangement without engaging said drive means.

In preference said drive means is a pinion gear including a plurality of gear teeth adapted to engage teeth on said rack.

An advantage of such an arrangement is that by using a rack and pinion to drive the bolt between its retracted and extended positions. A small diameter pinion gear may be used. This increase the drive ratio thereby maximising torque transferred from the drive to the bolt.

In preference said rack includes a cavity so located to allow for a first arm extending from said pinion gear to pass therethrough upon rotation of said pinion gear, said arm effecting said deadlocking arrangement by abutting against said rack cavity wall when said rack is moved independently of said pinion gear and where said pinion gear teeth are disengaged form said rack teeth.

In preference said pinion gear includes a second arm adapted to abut against a shoulder of said rack to from a mechanical stop. This prevents the lock from being overdriven.

In preference said second arm is parallel to and extends in the opposite direction to said first arm.

In a further form of the invention there is proposed a deadlocking assembly for use in locks said assembly including:

a rack having a plurality of teeth and supporting at one end a locking bolt;

a pinion gear having a plurality of teeth adapted to engage said rack teeth to cause said bolt to move in a longitudinal direction between an extended and a retracted position, said pinion gear further having two outwardly opposing arms wherein in the retracted position the first of said arms abuts a shoulder in the rack and in the extended position the second of said arms is located adjacent a surface wherein forcing of said bolt to the retracted position abuts said surface with said second of said arms thereby deadlocking said bolt.

BRIEF DESCRIPTION OF THE DRAWINGS

The accompanying drawings, which are incorporated in and constitute a part of this specification, illustrate several implementations of the invention and, together with the description, serve to explain the advantages and principles of the invention. In the drawings.

DESCRIPTION OF THE PREFERRED EMBODIMENTS

Figure 1:
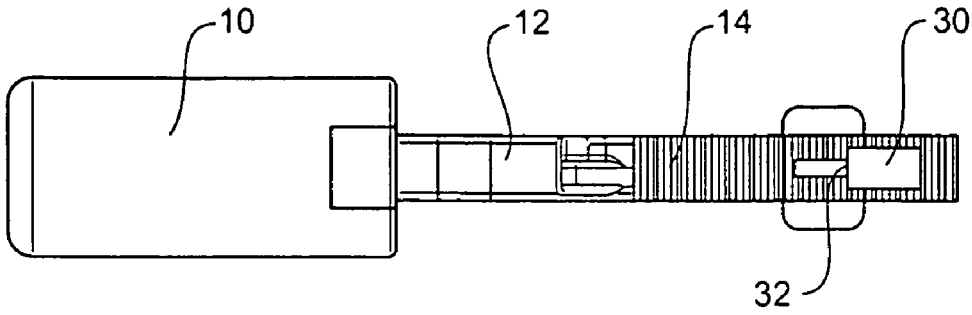
FIG. 1 is a plan view of a rack and lock bolt embodying the present invention.
Figure 2:
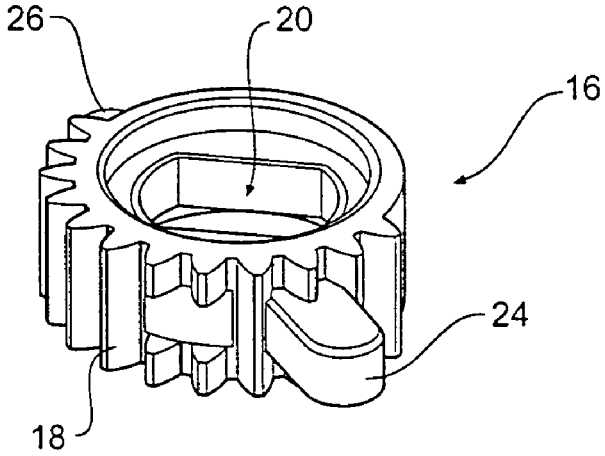
FIG. 2 is a perspective view of the pinion used in the present invention.
Figure 3:
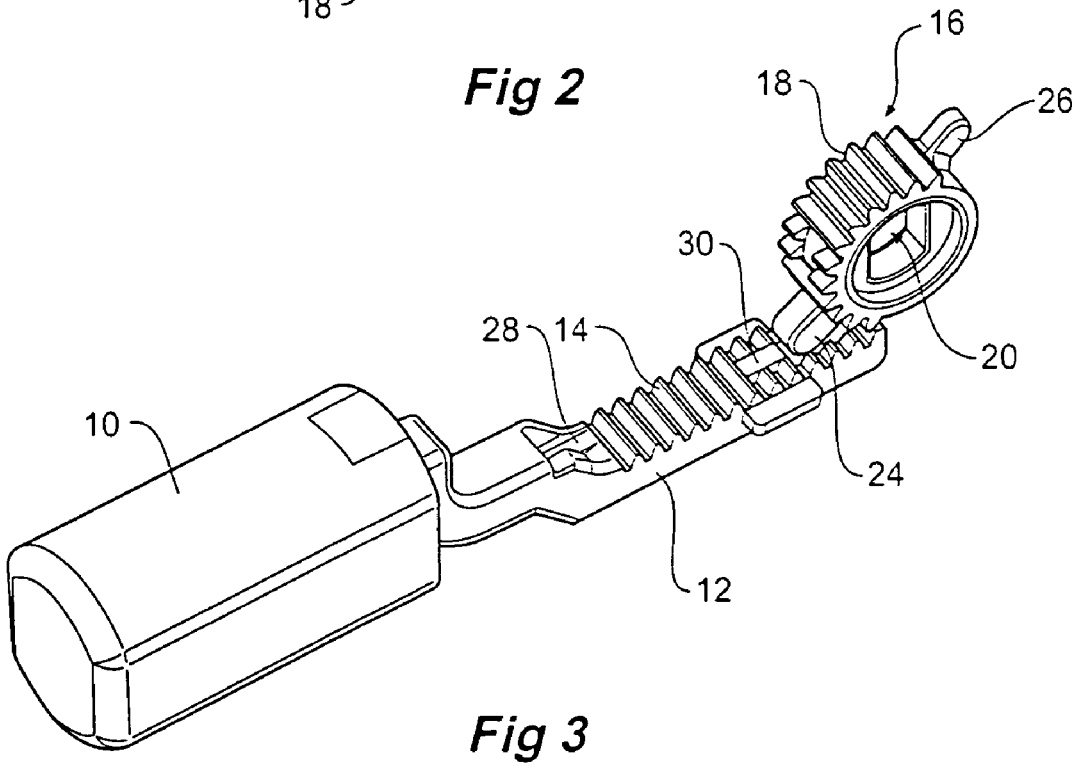
FIG. 3 is a perspective view of the pinion when engaging said rack and lock bolt in a deadlocked position.
Figure 4:
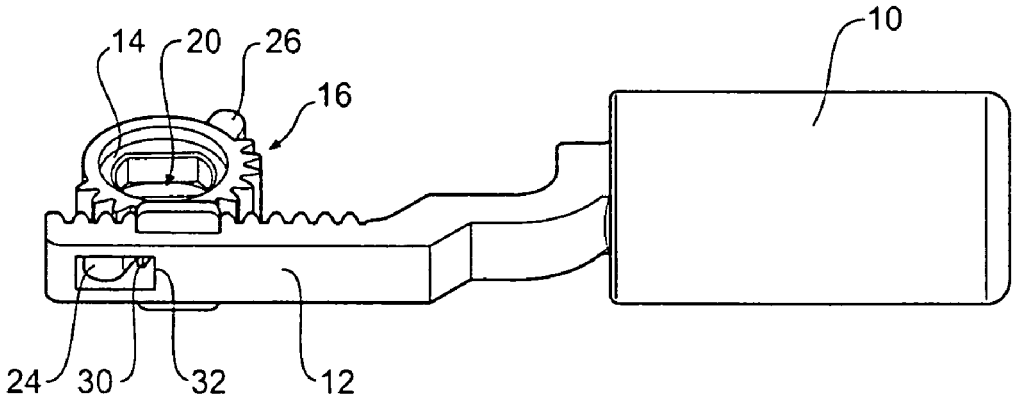
FIG. 4 is an underside perspective view of the pinion, rack, and lock bolt when not in a deadlocked position.
Figure 5:
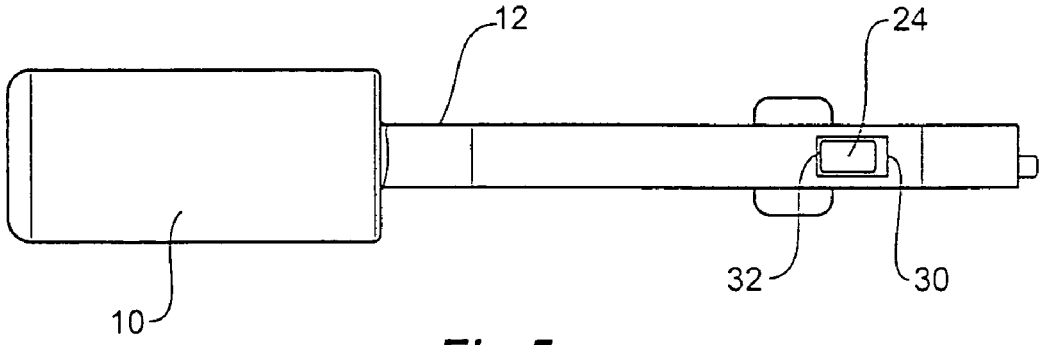
FIG. 5 is the underside view of the rack and lock bolt.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention is adapted for use in locks of the type where rotation of a driving shaft causes the bolt to move in and out of a doorframe. The rotational force is applied by either a key or by a driving motor. It is not intended to describe in detail the driving mechanism of such a lock or indeed other details of a complete lock assembly. For that the reader is referred to numerous patents that exist on this subject including an application by the present applicant titled Electronic deadbolt arrangement and allocated International Patent Application Number PCT/AU03/00893. It should be noted however that the present application is particularly useful with a lock of the type as described in that International Application.

Referring now to the drawings in detail, there is illustrated a lock bolt 10 operatively connected to a rack 12, the rack including a plurality of teeth 14. A pinion gear 16 drives the rack 12 by having a plurality of teeth 18 that engage the rack teeth 14. The pinion gear 16 is rotationally coupled to a driving shaft (not shown) by engaging slot 20 in the pinion gear 16. Thus upon rotation of the pinion gear 16 the rack 12 and hence the bolt 10 is caused to extend or retract typically into a cavity 21 in door frame 22 to lock or unlock a door.

Figure 6:
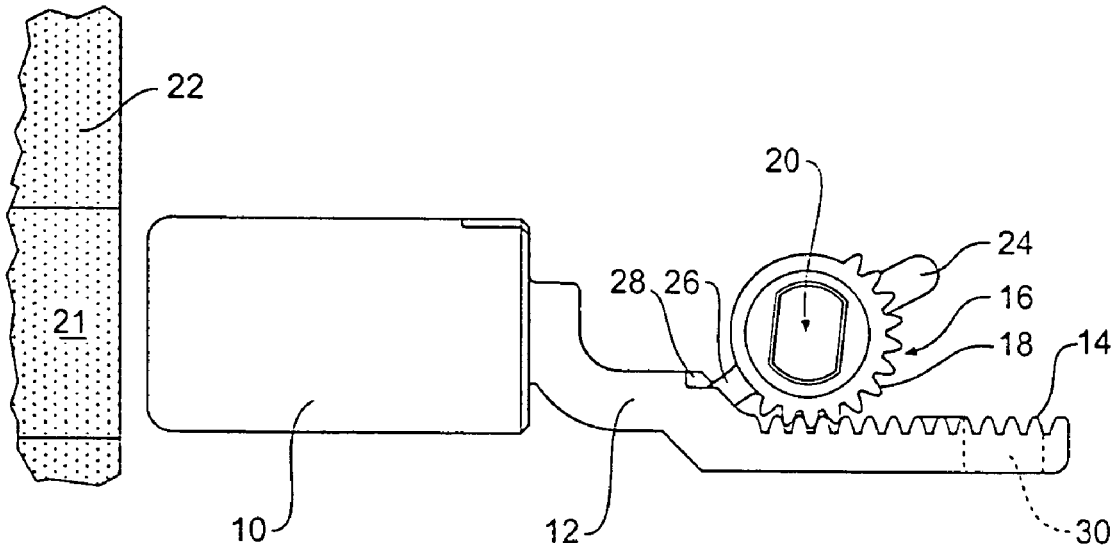
FIG. 6 is a side view of the pinion, rack, and lock bolt in an unlocked position.

The pinion gear 16 includes two arms 24 and 26 extending outwardly from the gear 16 and in opposite directions. Arm 24 deadlocks the lock whilst arm 26 prevents over travel of the bolt 10 when in the unlocked position. This is illustrated in FIGS. 6 to 9. FIG. 6 illustrates the bolt in the unlocked position where the pinion gear 16 has been rotated anti-clockwise until arm 26 abuts shoulder 28 in the rack 12 preventing further anti-clockwise rotation of the pinion gear 16 and thus retraction of the bolt.

Figure 7:
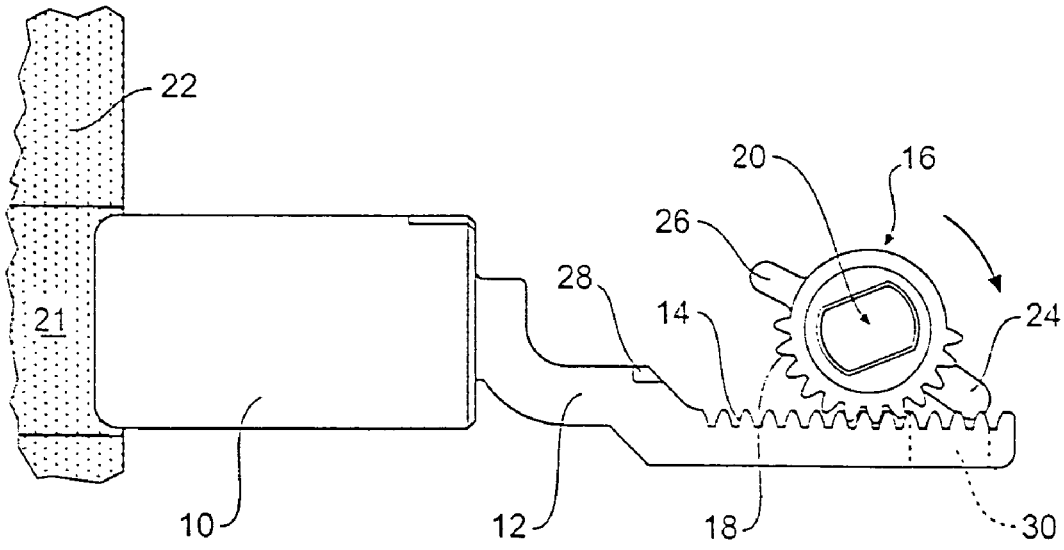
FIG. 7 is a side view as in FIG. 6 but when travelling towards the locked position.
Figure 8:
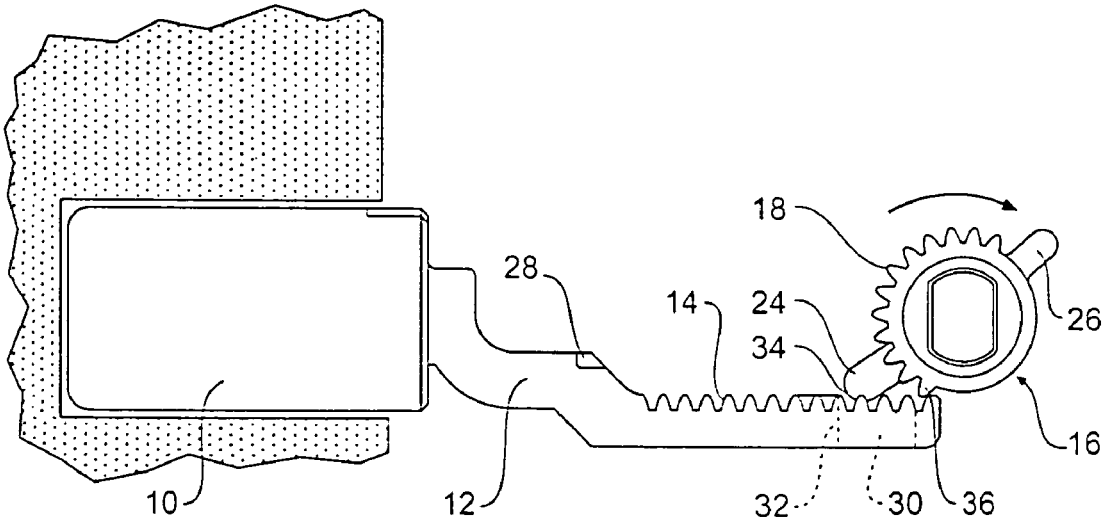
FIG. 8 is a side view of the pinion, rack and lock bolt when in the dead locked position.

Rotation of the pinion gear 16 in the clockwise direction lifts arm 26 out of shoulder 28, causes the pinion gear teeth 18 to engage rack teeth 14 and move the rack and thus bolt outwards to start to enter doorframe cavity 21 as shown in FIG. 7. Yet further clockwise rotation of the pinion gear causes further extension of the bolt, arm 24 passing freely through cavity 30 in the rack 12 until the bolt is in the fully extended position as illustrated in FIG. 8.

Still further rotation of the pinion gear 16 disengages the pinion gear teeth 18 from the rack teeth 14 and brings the arm 24 near abutment of a rack wall 32.

From the locked to the unlocked position the pinion gear rotates through approximately 170 degrees.

Figure 9:
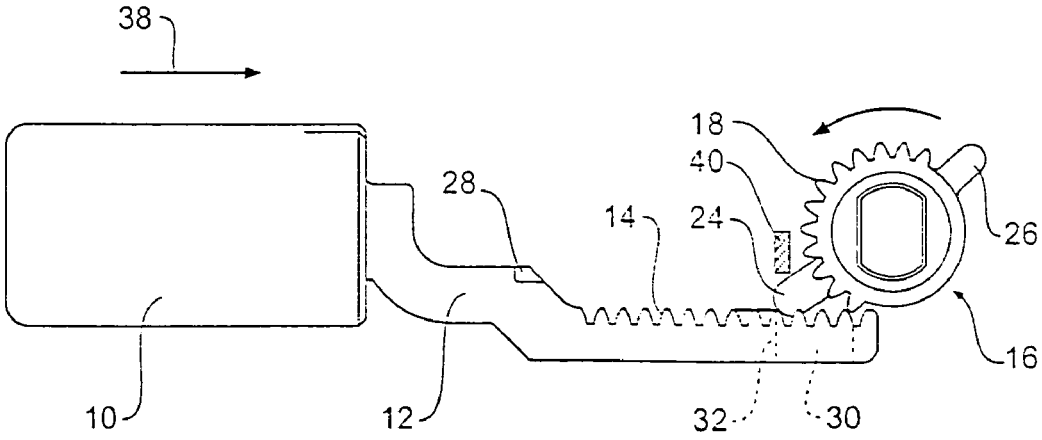
FIG. 9 is a side view as in FIG. 8 but when the lock has been forced.

In the locked position the gap 34 between arm 24 and cavity wall 32 is smaller than the gap 36 between the engaging teeth of the gear and the rack. Accordingly movement of the bolt by force in direction 38 that would occur if the bolt were being forced causes the arm 24 to abut wall 32 as illustrated in FIG. 9. At this position the teeth 18 and 14 of the pinion gear and the rack respectively have not engaged meaning that the deadlock has been effectively maintained and further movement of the bolt and the rack is prevented. The deadlock can therefore only be removed by driving the pinion gear to engage the rack. A tab 40 may assist in preventing over travel of the pinion arm 24 when locking the bolt 10.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word—"comprising" is used in the sense of "including", i.e. the features specified may be associated with further features in various embodiments of the invention.

What is claimed is:

1. A deadlocking assembly for use in locks, said assembly comprising:

a lock bolt operatively coupled to a rack;

a drive means adapted to be rotatably driven and adapted to engage said rack to cause it to move in one axis;

said drive means including a deadlocking arrangement whereby when said bolt is in an extended position, external movement of the bolt towards the retracted position causes said rack to abut said deadlocking arrangement without engaging said drive means; wherein said drive means is a pinion gear including a plurality of gear teeth for engaging a plurality of teeth on said rack; and wherein said rack includes an aperture so located to allow for a first arm extending from said pinion gear to pass into the aperture upon rotation of said pinion gear, said first arm effecting said deadlocking arrangement by abutting against a wall which defines a portion of said rack aperture.

2. The deadlocking assembly as in claim 1 wherein said pinion gear includes a second arm which abuts against a shoulder in said rack when said rack has been fully retracted.

3. The deadlocking assembly as in claim 2, wherein said second arm is parallel to and extends in the opposite direction to said first arm.

4. The assembly of claim 1 wherein the first arm extends radially outwardly farther than do the pinion gear teeth.

5. The assembly of claim 1 wherein the rack is formed as a single member.

6. The assembly of claim 1 wherein the pinion rotates approximately 170 degrees from an unlocked position associated with the retracted position of the bolt and a locked position associated with the extended position of the bolt.

7. A deadlocking assembly for use in locks, said assembly comprising:

a rack having a plurality of teeth and supporting at one end a locking bolt;

a pinion gear having a plurality of teeth for selectively engaging said rack teeth to cause said bolt to move in a longitudinal direction between an extended and a retracted position, said pinion gear further having first and second outwardly opposing arms, wherein in the extended position the first of said arms is disposed adjacent a surface bounding an aperture in the rack, wherein forcing of said bolt toward the retracted position abuts said surface with said first of said arms, thereby deadlocking said bolt; and wherein in the retracted position the second of said arms abuts the rack to prevent over travel of the bolt.

8. The assembly of claim 7 wherein each of the first and second arms extends radially outwardly farther than do the pinion gear teeth.

9. The assembly of claim 7 wherein the first arm extends radially outwardly in a first direction; and wherein the second arm extends radially outwardly in a second direction which is opposite to and substantially parallel to the first direction.

10. A deadlocking assembly for use in locks, said assembly comprising:

a lock bolt operatively coupled to a rack including a plurality of rack teeth;

a pinion gear including a plurality of gear teeth for rotatably engaging the rack teeth to cause the bolt to move between retracted and extended positions;

a first arm extending radially outwardly from the pinion gear and rotatable therewith;

the rack having a rack surface which faces away from the bolt so that the first arm may pass adjacent the rack surface upon rotation of the pinion gear;

wherein the rack defines a rack aperture; and wherein the rack surface bounds the rack aperture so that the first arm may pass into the rack aperture adjacent the rack surface upon rotation of the pinion gear; and wherein when the bolt is in the extended position, external movement of the bolt towards the retracted position forces the rack surface against the first arm to deadlock the bolt.

11. The assembly of claim 10 wherein the rack includes a pair of opposed walls which extend from the rack surface away from the bolt and which bound the rack aperture therebetween.

12. The assembly of claim 11 wherein each of the opposed walls includes a portion of at least one rack tooth so that the rack aperture is disposed intermediate the portion of the at least one tooth on one of the opposed walls and the portion of the at least one tooth on the other of the opposed walls.

13. The assembly of claim 10 the bolt is mounted adjacent a first end of the rack; and wherein the rack aperture is disposed adjacent a second opposed end of the rack.

14. The assembly of claim 10 the bolt is mounted adjacent a first end of the rack; and wherein the rack surface is disposed adjacent a second opposed end of the rack.

15. The assembly of claim 10 wherein the first arm extends radially outwardly farther than do the pinion gear teeth.

16. The assembly of claim 10 wherein when the bolt is in the extended position, the rack teeth and the gear teeth define therebetween a first gap and the first arm and the rack surface define therebetween a second gap which is smaller than the first gap whereby when the external movement of the bolt towards the retracted position forces the rack surface against the first arm, the gear teeth are disengaged from the rack teeth.

17. The assembly of claim 10 wherein the pinion gear teeth are disengaged from the rack teeth when the external movement of the bolt towards the retracted position forces the rack surface against the first arm.

18. The assembly of claim 10 wherein the rack is formed as a single member.

19. The assembly of claim 10 wherein the pinion rotates approximately 170 degrees from an unlocked position associated with the retracted position of the bolt and a locked position associated with the extended position of the bolt.

* * * * *